United States Patent [19]

Mochizuki et al.

[11] 4,295,414

[45] Oct. 20, 1981

[54] DIAPHRAGM-TYPE FUEL PUMP

[75] Inventors: Hiroshi Mochizuki; Tokio Seki, both of Sowamachi, Japan

[73] Assignee: Kyosan Denki Kabushiki Kaisha, Tokyo, Japan

[21] Appl. No.: 85,037

[22] Filed: Aug. 9, 1979

[51] Int. Cl.[3] ..... F15B 21/04; F04B 45/10

[52] U.S. Cl. ..... 92/98; 417/471

[58] Field of Search ..... 417/471, 540, 541, 542, 417/543; 92/78, 79

[56] References Cited

U.S. PATENT DOCUMENTS

| | | | |
|---|---|---|---|
| 1,687,793 | 10/1928 | Remington | 417/543 |
| 1,809,394 | 6/1931 | Schweisthal | 417/543 |
| 1,897,292 | 2/1933 | Habitch | 417/543 |
| 1,905,246 | 4/1933 | Schweisthal | 417/543 |
| 2,351,304 | 6/1944 | Tabb | 417/435 |
| 3,330,216 | 7/1967 | Schimmeldfenig | 417/543 |
| 3,635,598 | 1/1972 | Sieper | 417/471 |
| 4,153,394 | 5/1979 | Nakada | 417/571 |

FOREIGN PATENT DOCUMENTS

| | | | |
|---|---|---|---|
| 1804532 | 10/1970 | Fed. Rep. of Germany | 417/542 |
| 386250 | 1/1933 | United Kingdom | 417/471 |

*Primary Examiner*—William L. Freeh

*Attorney, Agent, or Firm*—Blanchard, Flynn, Thiel, Boutell & Tanis

[57] ABSTRACT

A diaphragm-type fuel pump defining therein an outlet chamber for supplying fuel to a carburetor. A return pipe is connected to the interior of the outlet chamber to permit return of vapors to the fuel tank. An outlet pipe communicates with the outlet chamber for supplying fuel to the carburetor float chamber. The fuel pump has an outlet valve associated therewith for supplying fuel into the outlet chamber. The open inlet end of the return pipe communicates with the outlet chamber at an elevation which is higher than the elevation of the outlet valve, and the inlet opening of the outlet pipe communicates with the outlet chamber at an elevation which is lower than the elevation of the outlet valve, whereby vapors within the outlet chamber are prevented from passing through the outlet pipe to the carburetor.

2 Claims, 2 Drawing Figures

DIAPHRAGM-TYPE FUEL PUMP

FIELD OF THE INVENTION

This invention relates to diaphragm-type fuel pumps for automotive internal combustion engines.

BACKGROUND OF THE INVENTION

In the internal combustine engine fuel supply system, vaporization of fuel constitutes one of the serious problems. Vaporization results from heating of fuel due to heat generated from the engine. It not only obstructs the supply of fuel, but the vapor thus produced is forced into the carburetor so that the air/fuel ratio is changed and thus adversely affects the engine operation.

As a means for preventing vapor from being supplied to the carburetor, there is provided a return system. In the return system, the outlet chamber of the fuel pump is provided with a return pipe communicating with the fuel tank for returning vapor, and extra fuel if necessary, to the fuel tank. Such a known return system is shown in FIG. 1 but, as explained hereinafter, it does not sufficiently avoid the vapor problem.

This invention thus relates to a diaphragm-type fuel pump which incorporates an improved vapor return system associated therewith.

DETAILED DESCRIPTION

Figure 1:
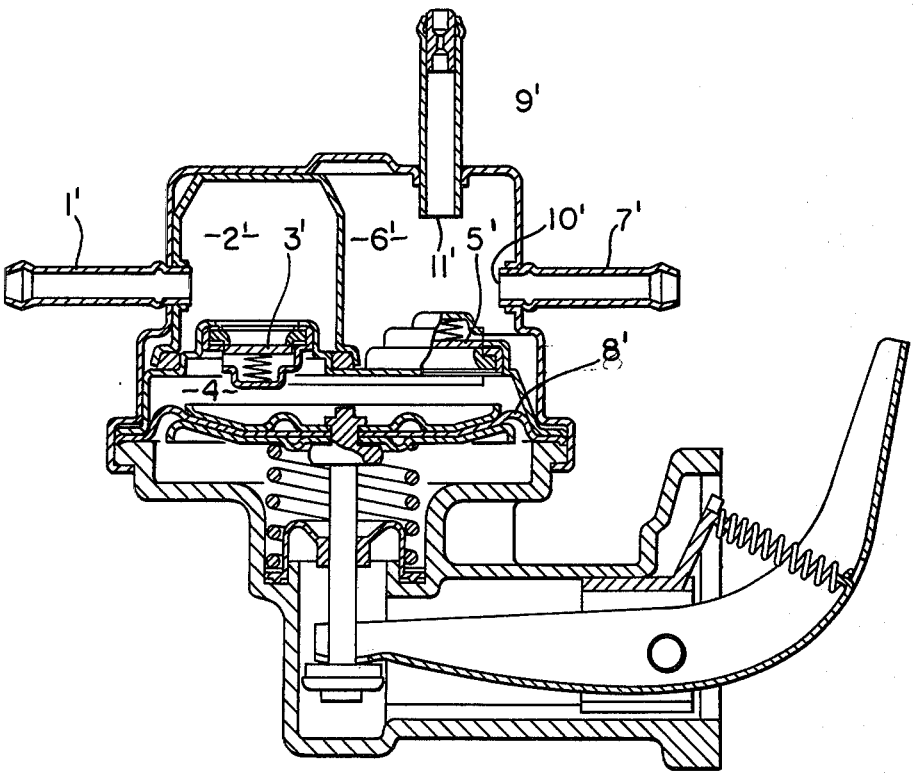
FIG. 1 PRIOR ART
FIG. 1 is a sectional view showing an example of the prior-art fuel pump.

Referring to FIG. 1, there is shown a known fuel pump wherein fuel flows through an inlet pipe 1' into an inlet chamber 2' and thence through an inlet valve 3' into a pump chamber 4'. Then, it is forced through an outlet valve 5' into an outlet chamber 6' and thence through an outlet pipe 7' to a carburetor (not shown). Fuel is withdrawn and exhausted with the reciprocation of a flexible diaphragm 8'. The outlet chamber 6' is provided with a return pipe 9'.

In the above fuel pump, which is well known in the art, the open end 10' of the outlet pipe 7' and the open end 11' of the return pipe 9' are provided at different elevations. More particularly, since vapor is collected above the outlet chamber 6', the open end 11' of the return pipe 9' is provided at a higher level to prevent vapor from being supplied through the outlet pipe 7' to the carburetor.

However, the above well-known fuel pump cannot yet sufficiently avoid vapor passing through the outlet pipe 7'. More specifically, vapor is forced together with fuel through the outlet valve 5' into the outlet chamber 6', and thence it is forced in the mixed state through the outlet pipe 7'.

Figure 2:
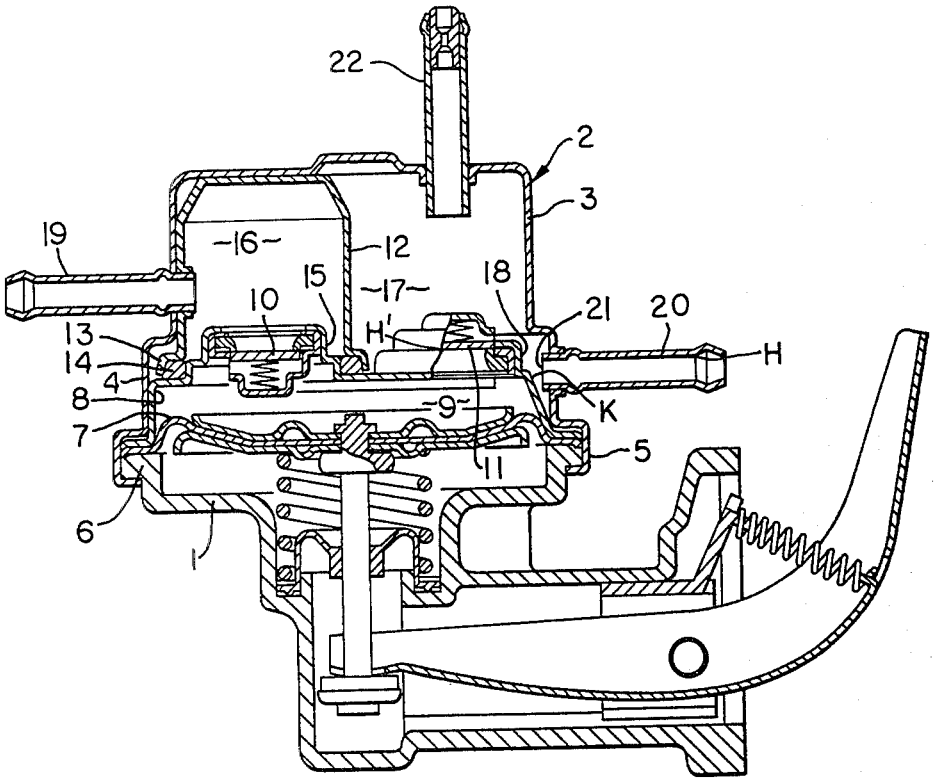
FIG. 2 is a sectional view showing an embodiment of the invention.

This invention seeks to provide a diaphragm-type fuel pump, which can overcome the above drawback and reliably prevent vapor from being supplied through the outlet pipe to the carburetor. The improved pump of this invention is shown in FIG. 2, as hereinafter described.

Designated at 1 is a diecast lower body, on which an outer casing 2 is fitted. The outer casing 2 is formed by drawing a thin metal sheet, and it consists of three cylindrical sections 3, 4 and 5 of progressively greater diameters toward its mouth. Between the outer casing 2 and a flange 6 of the lower body 1 a diaphragm 7 and a separator 8 are clamped. The separator 8 is made of a thin metal sheet and defines a pump chamber 9 together with the diaphgram 7.

The separator 8 carries an intake valve 10 and an outlet valve 11 both secured to it. An inlet chamber shell 12 is formed with an outwardly flared seal retainer 13 defined at its mouth. It engages the first cylindrical section 3 of the outer casing 2, with its seal retainer 13 extending into the space K defined by the second cylindrical section 4, and it covers the inlet valve 10 and rests on the separator 8.

A seal 14 surrounds a recess-forming portion 15 of the separator 8, in which the inlet valve is pressure fitted, and it seals the space between the inlet chamber 16 and outlet chamber 17. The outlet valve 11 is also pressure fitted in and held by a recess-forming portion 18 of the separator 8.

The structure of the fuel pump, as described above relative to FIG. 2, is explained in greater detail in U.S. Pat. No. 4,153,394, the disclosure of which is incorporated herein by reference.

An inlet pipe 19 penetrates the first cylindrical section 3 of the outer casing 2 and the inlet chamber shell 12 and is in open communication with the inlet chamber 16. An outlet pipe 20 penetrates the second cylindrical section 4 of the outer casing and opens into the outlet chamber 17. The open end 21 of the outlet pipe 20 is at an elevation or position H which is lower in level than the elevation H' of the outlet valve 11. A return pipe 22 penetrates the outer casing 2 and opens into an upper portion of the outlet chamber 17.

The operation of the above construction according to the invention will now be described.

As the diaphragm 7 is reciprocated, fuel is withdrawn through the inlet pipe 19 into the inlet chamber 16, and thence it is led through the inlet valve 10 into the pump chamber 9. Then, it is forced through the outlet valve 11 into the outlet chamber 17 and thence through the outlet pipe 20 to a carburetor (not shown).

In the outlet chamber 17 vapor is collected in the upper portion, so that it is returned through the return pipe 22 to the fuel tank.

When a great quantity of vapor is contained in the fuel supplied through the outlet valve 11 to the outlet chamber 17, the level of the fuel within the outlet chamber 17 is reduced.

In such a case, with the prior-art fuel pump as described in connection with FIG. 1, vapor is supplied through the outlet pipe 7' to the carburetor.

According to this invention (FIG. 2), the open inlet end 21 of the outlet pipe 20 is at a lower elevation than the outlet valve 11, so that the fuel level never becomes lower than that of the open end 21 of the outlet pipe 20. Thus, vapor is never supplied through the outlet pipe 20.

While an embodiment of the invention has been described above, it is to be understood that the invention covers all fuel pump constructions where the open end of the outlet pipe assumes a position lower in level than the position of the outlet valve.

As has been described in the foregoing, according to the invention it is possible to reliably prevent vapor from being supplied through the outlet pipe into the carburetor.

Further, by using an outer casing constructed in three stages it is possible to simply have the open end of the outlet pipe assume a position lower in level than the position of the outlet valve by making use of the second cylindrical section.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a diaphragm-type fuel pump, including a body having an opening therein, a pumping diaphragm extending across and closing said opening, a cup-shaped outer casing positioned over said diaphragm and connected to said body, said outer casing having an end wall spaced a substantial distance from said diaphragm, said outer casing having three axially-spaced sections with a first said section being disposed directly adjacent said end wall and a second said section being cylindrical and disposed axially between said first section and a third said section, said third section being cylindrical and defined at the mouth of said outer casing and connected to said body, said third section having a diameter greater than said second section, said second section having a cross-sectional area greater than said first section, a separator positioned within and extending diametrically across said outer casing, said separator being positioned axially between said end wall and said diaphragm and being spaced from said diaphragm to define a pumping chamber therebetween, said separator and said diaphragm having the peripheral edges thereof fixedly interposed between said body and said outer casing within said third cylindrical section, said separator having cylindrically projecting inlet and outlet valve holding sections formed thereon and projecting axially of said separator toward said end wall, inlet and outlet valve means respectively mounted within said inlet and outlet valve holding sections, and divider means disposed within the compartment defined within said outer casing between said end wall and said separator for dividing said compartment into inlet and outlet chambers which respectively communicate with the inlet and outlet valve means, a fuel inlet pipe projecting through the outer casing for communication with the inlet chamber, and a fuel outlet pipe connected to the outer casing for communication with the outlet chamber, comprising the improvement wherein the fuel outlet pipe is connected to the second section of said outer casing and has an inlet opening associated with the end thereof which is disposed in direct communication with said outlet chamber, said inlet opening in its entirety being disposed at an elevation below the elevation of said outlet valve means so that the inlet opening is continuously immersed in its entirety within a reservoir of fuel which collects within said outlet chamber below the elevation of said outlet valve means, and a return pipe connected to said casing for direct communication with said outlet chamber for removing vapors from the upper portion of said outlet chamber, said return pipe having an inlet opening formed at the end thereof in direct communication with said outlet chamber at an elevation which is substantially higher than the elevation of said outlet valve means so that said last-mentioned inlet opening is not immersed in the fuel reservoir to permit continuous removal of vapors from said outlet chamber.

2. In a diaphragm-type fuel pump including a housing defining therein an interior chamber, a pumping diaphragm positioned within and extending across a portion of said interior chamber, a separator plate also extending across a part of said interior chamber and being spaced from the pumping diaphragm to define a pumping chamber therebetween, said separator plate having inlet and outlet valve means associated therewith at locations spaced from one another, said housing having a dividing wall associated with said interior chamber and cooperating with the separator plate for defining within said housing inlet and outlet chambers which respectively communicate with the inlet and outlet valve means, said inlet and outlet chambers being disposed on the opposite side of the separator plate from the pumping chamber, a fuel inlet pipe communicating with said inlet chamber for supplying fuel thereto, and the outlet valve means being disposed at an elevation located above the lowermost elevation of the outlet chamber to define within the outlet chamber a reservoir of fuel which collects therein below the elevation of said outlet valve means, comprising the improvement wherein a vapor return pipe is connected to the interior of the outlet chamber for returning vapors to the fuel tank, the return pipe having an inlet opening disposed in direct and open communication with the outlet chamber substantially adjacent the upper portion thereof and at an elevation which is substantially higher than the elevation of said outlet valve means for permitting withdrawal of vapors from the outlet chamber, and a fuel outlet pipe in direct communication with said outlet chamber for supplying fuel to a carburetor or the like, said fuel outlet pipe having an inlet opening which in its entirety is in open and direct communication with said outlet chamber at an elevation which is lower than the elevation of said outlet valve means so that said last-mentioned inlet opening is immersed in its entirety within said reservoir of fuel for effectively preventing vapors from flowing into said outlet pipe.

* * * * *

UNITED STATES PATENT AND TRADEMARK OFFICE

CERTIFICATE OF CORRECTION

PATENT NO. : 4 295 414

DATED : October 20, 1981

INVENTOR(S) : Hiroshi Mochizuki and Tokio Seki

It is certified that error appears in the above—identified patent and that said Letters Patent is hereby corrected as shown below:

First page, Appl. No.; Item [21] "85,037" should read --62,037--.

Signed and Sealed this

***Twenty-seventh* Day of *July 1982***

[SEAL]

*Attest:*

GERALD J. MOSSINGHOFF

*Attesting Officer* *Commissioner of Patents and Trademarks*